US008785358B2

(12) United States Patent
Fischer et al.

(10) Patent No.: US 8,785,358 B2
(45) Date of Patent: Jul. 22, 2014

(54) PROCESS FOR PRODUCING LUBRICATING GREASE

(75) Inventors: Matthias Fischer, Worms (DE); Markus Scherer, Köln (DE); Michael Müller, Bensheim (DE)

(73) Assignee: Evonik Rohmax Additives GmbH, Darmstadt (DE)

( * ) Notice: Subject to any disclaimer, the term of this patent is extended or adjusted under 35 U.S.C. 154(b) by 1347 days.

(21) Appl. No.: 11/587,988

(22) PCT Filed: Feb. 24, 2005

(86) PCT No.: PCT/EP2005/001906

§ 371 (c)(1),
(2), (4) Date: Jan. 16, 2007

(87) PCT Pub. No.: WO2006/094500

PCT Pub. Date: Sep. 14, 2006

(65) Prior Publication Data

US 2007/0191238 A1 Aug. 16, 2007

(30) Foreign Application Priority Data

Apr. 30, 2004 (DE) ..... 10 2004 021 717

(51) Int. Cl.
*C10M 145/14* (2006.01)

(52) U.S. Cl.
USPC ..... 508/469; 508/491

(58) Field of Classification Search
USPC ..... 508/591, 469
See application file for complete search history.

(56) References Cited

U.S. PATENT DOCUMENTS

| | | | | |
|---|---|---|---|---|
| 3,728,261 | A | 4/1973 | Mitacek et al. | |
| 4,149,984 | A | 4/1979 | Wenzel et al. | |
| 4,618,439 | A | 10/1986 | Brandi et al. | |
| 5,110,490 | A | 5/1992 | Pink et al. | |
| 6,080,794 | A | 6/2000 | Auschra et al. | |
| 6,172,012 | B1 * | 1/2001 | Kumar et al. | 508/165 |
| 6,409,778 | B1 | 6/2002 | Auschra et al. | |
| 6,458,750 | B1 | 10/2002 | Dardin et al. | |
| 6,639,099 | B1 | 10/2003 | Knebel et al. | |
| 6,774,091 | B2 * | 8/2004 | Dituro et al. | 508/168 |
| 2002/0123583 | A1 | 9/2002 | Gore et al. | |
| 2004/0254080 | A1 * | 12/2004 | Sivik et al. | 508/136 |
| 2005/0148749 | A1 | 7/2005 | Scherer et al. | |
| 2005/0239937 | A1 | 10/2005 | Scherer et al. | |
| 2005/0245406 | A1 | 11/2005 | Scherer et al. | |
| 2005/0261143 | A1 | 11/2005 | Scherer et al. | |
| 2005/0267239 | A1 | 12/2005 | Scherer | |
| 2006/0142168 | A1 | 6/2006 | Kinker et al. | |
| 2006/0189490 | A1 | 8/2006 | Dardin et al. | |
| 2008/0194861 | A1 | 8/2008 | Schmitt et al. | |
| 2008/0300373 | A1 | 12/2008 | Schmitt et al. | |

FOREIGN PATENT DOCUMENTS

| | | |
|---|---|---|
| EP | 0 405 893 | 1/1991 |
| EP | 0 867 500 | 9/1998 |
| EP | 0 995 790 | 4/2000 |
| JP | 50-035083 | 11/1975 |
| JP | 03-070797 | 3/1991 |
| JP | 04-046997 | 2/1992 |

OTHER PUBLICATIONS

U.S. Appl. No. 12/306,019, filed Dec. 22, 2008, Boehmke, et al.
U.S. Appl. No. 10/593,082, filed Sep. 15, 2006, Scherer, et al.
U.S. Appl. No. 10/592,363, filed Sep. 11, 2006, Scherer, et al.
U.S. Appl. No. 11/547,612, filed Oct. 4, 2006, Scherer, et al.
U.S. Appl. No. 11/572,181, filed Jan. 16, 2007, Scherer, et al.
U.S. Appl. No. 11/572,330, filed Jan. 19, 2007, Acker, et al.
U.S. Appl. No. 11/995,949, filed Jan. 17, 2008, Stoehr, et al.
U.S. Appl. No. 11/815,624, filed Aug. 6, 2007, Mueller, et al.
U.S. Appl. No. 11/909,171, filed Sep. 20, 2007, Stoehr, et al.
U.S. Appl. No. 12/279,732, filed Aug. 18, 2008, Stoehr, et al.
Scharf C. R., et al. "The Enhancement of Grease Structure Through the Use of Functionalized Polymer Systems" NLGI's 62$^{nd}$ Annual Meeting, vol. 59, XP 009047208, pp. 8-16, 1995.
Notification of Reasons for Refusal in Japanese Application No. 2007-509894 dated Feb. 10, 2011. (English Translation).
U.S. Appl. No. 12/668,209, filed Jan. 8, 2010, Stoehr, et al.
U.S. Appl. No. 61/186,744, filed Jun. 12, 2009, Radano, et al.
U.S. Appl. No. 12/672,231, filed Feb. 4, 2010, Stoehr, et al.
Canadian Office Action in corresponding Application No. 2,563,976, dated Sep. 2, 2011.
German Office Action in corresponding German Application No. 10 2004 021 717.3, dated Apr. 25, 2012.
Office Action in corresponding Canadian Application No. 2,563,976 dated Jan. 17, 2013.
Canadian Office Action in Canadian patent application No. 2,563,976 dated May 30, 2012.

* cited by examiner

*Primary Examiner* — Jim Goloboy
(74) *Attorney, Agent, or Firm* — Oblon, Spivak, McClelland, Maier & Neustadt, L.L.P.

(57) ABSTRACT

The present invention relates to a process for producing lubricating grease by adding a polymeric structure improver in a composition liquid at 25° C. to the dispersion to a dispersion which has grease structure and comprises at least one thickener and at least one lubricating oil.

19 Claims, No Drawings

PROCESS FOR PRODUCING LUBRICATING GREASE

The present invention relates to processes for producing lubricating grease.

Lubricating greases are known per se and have many uses. Lubricating greases, also referred to hereinafter as "greases" are solid to semifluid substances which are formed by dispersing a thickener in a fluid lubricant. Other additives which impart particular properties may be present.

The basic consistency of a grease is determined by the combination of base fluid and thickener. The base fluid is generally a base oil customary in the lubricants industry, for example mineral oil, synthetic oil or vegetable oil.

The thickeners used are typically alkali metal or alkaline earth metal soaps. Also known are thickeners which have not yet been soap-based, for example bentonite (clay-based) or polyurea.

The production of greases is a consequence of physicochemical processes, with the aid of which the lubricating grease structure is constructed from thickener molecules generated in situ. In total, at least 2, possibly even 3, process phases have to be passed through.

(1) In the reaction phase, metal soap molecules are generated by reaction of the corresponding starting materials in the base oil. The metal soap molecules are present as fine crystals.

(2) In the structure formation phase which follows, the actual lubricating grease structure or lubricating grease matrix is generated by physicochemical processes. In the course of this, different processes proceed, for example the aggregation of the thickener crystals generated in phase 1, the formation of soap micelles by intercalation and adsorption of base oil molecules, the commencement of melting of the soap micelles (=heating above the melting point of the soap molecules) and finally the recystallization of the soap molecules (=controlled cooling).

(3) In a mechanical phase, additives, solid lubricants and the like, and also setting oil for fine adjustment of the end consistency, are added. The additives are the additives customary in the lubricants industry, such as antioxidants, corrosion inhibitors, antiwear additives and metal deactivators. The incorporation of constituents insoluble in the grease, such as solid lubricants, in the mechanical phase is likewise undertaken.

Lubricating greases may be produced in batch processes or by continuous processes. Continuous processes consume less energy and have a high production output with low dimensions of the plants. However, they have not been able to become established over the batch processes. A reason for this can be assumed to be that the continuous processes are relatively inflexible. Since the switching of the plants is associated with costs, relatively large amounts of a particular grease type have to be produced. Lubricating greases which are required in smaller amounts are therefore in many cases produced by the more energy-intensive batch processes.

U.S. Pat. No. 3,791,972, Myers et al., 12 Feb. 1974, describes the production of an aluminium complex grease with addition of polyisobutylene polymers having an Mw of 9000-25 000. The polymer is added at 160° C. during the structure formation phase of the grease (Example 1, page 5).

U.S. Pat. No. 3,891,564, Carley et al., 24 Jun. 1975, describes the production of a mixed grease consisting of alkali metal and alkaline earth metal soap thickened greases which have also been admixed with addition of polymer derivatives of alkoxylated alcohols, for example at a temperature of 82-104° C. (Example 1, column 7).

EP-A 084 910, Tanaka et al., 3 Aug. 1983 (priority JP 6757/82 and 6758/82, 21 Jan. 1982), describes the preparation of a lithium complex grease with a high dropping point and improved anti-noise behaviour. In this case, polymers (styrene-butadiene copolymers, styrene-isoprene copolymers, polymethyl methacrylates, polyisobutylenes and ethylene-propylene copolymers) are added additionally. The polymer is added at 80° C. before the structure formation phase of the grease (process description, page 9). For structure formation, the mixture is heated to 195-215° C.

U.S. Pat. No. 5,116,522, Brown et al., 23 Aug. 1989, describes a grease-like lubricant composition based on base oil, thickener, viscosity index improver and a copolymer of ethylene and at least one further monomer from the group of vinyl acetate, alkyl acrylate or alkyl methacrylate. Preference is given to ethylene-vinyl acetate (EVA) which is added during the preparation process at temperatures between 120° C. and 180° C. (description, page 5 line 10 ff.).

U.S. Pat. No. 6,300,288, Curtis et al., 31 Mar. 1994, describes a lubricating grease consisting of an oil having a viscosity typical of a lubricant, a polymer consisting of an α-olefin/diene copolymer or a hydrogenated α-olefin/diene copolymer, a metallic species capable of interacting with the acid functionality of the polymer in order to achieve an association between the acid groups, and a co-thickener. The polymer is added during the reaction phase of the lubricating grease under conditions of heating and stirring, preferably between 100° C. and 200° C.

EP 700986, Meijer at al., 13 Mar. 1996, describes a polymeric thickener for a lubricating grease composition, the thickener consisting of (1) a high molecular weight co- or homopolymer of propylene having a mean molecular weight of >200 000 and (2) a low molecular weight propylene having a molecular weight of <100 000. Oil bleeding at low temperatures and also the anti-noise behaviour and the mechanical stability of the grease are improved. In this case, the polymer is incorporated within a temperature range above the melting point of the polymer, i.e. in the temperature range of 190-210° C.

According to the prior art detailed above, the addition of polymers to lubricating greases improves certain physical parameters, for example Theological properties or the water resistance of the greases. However, the described addition of polymers during or before their production process is a restriction to the user, since he or she has to adjust to certain formulations and process parameters which cannot be changed easily.

The processes described in the prior art for producing lubricating greases can in many cases be carried out inexpensively. However, what is in need of improvement is in particular that the processes are relatively inflexible. Thus, lubricating greases with different quality have to be produced in different production batches, which can result in particular in high storage costs or in the customer having to expect relatively long waiting times. Therefore, the low flexibility of the known processes leads to disadvantages which are in turn associated with costs.

In addition, the processes for producing the aforementioned lubricating greases are relatively difficult to control, so that certain specifications can be maintained only with great difficulty. Accordingly, processes for their production shall be provided which enable the subsequent modification of the finished lubricating greases to these specifications, so that the properties of the lubricating greases can be adjusted to predefined values.

In addition, the lubricating greases obtainable by the present process should have outstanding properties. These include particularly high water resistance, excellent consistency and high homogeneity.

In addition, it should be possible in the processes for preparing lubricating greases in particular to use commercially available components. At the same time, it should be possible to produce on the industrial scale without any need for new plants or plants having complicated construction.

These objects and further objects which are not stated explicitly but which can be derived or discerned from the connections discussed by way of introduction herein are achieved by processes for producing lubricating grease with improved properties having all features of Claim 1. Appropriate modifications to the processes according to the invention are protected in the subclaims referring back to claim 1.

By virtue of a polymeric structure improver being added in a composition liquid at 25° C. to a dispersion which has grease structure and comprises at least one lubricating oil, it is possible in a not directly foreseeable manner to provide processes for producing lubricating grease with which the properties of lubricating greases can be improved in a simple manner. At the same time, the processes according to the invention can achieve a series of further advantages. These include:

- The processes according to the invention are very flexible. Thus, lubricating greases with different quality can be produced from one production batch, as a result of which high storage costs in particular can be avoided. In addition, it is possible to react rapidly to customer requests.
- The processes according to the invention enable lubricating greases with predetermined specifications to be obtained in a simple manner.
- The process of the present invention can be carried out particularly easily and simply. In these processes customary industrial scale plants can be used.
- Furthermore, lubricating greases obtainable by the present process have outstanding properties. These include particularly high water resistance, excellent consistency and high homogeneity.
- In addition, commercially available components in particular can be used in the processes for producing the lubricating greases.

The process according to the invention is especially surprising because it had to be assumed to date that subsequent addition of structure-modifying polymers leads to a change in the grease structure. Addition of these polymers after the structure formation phase can therefore lead to a change in the consistency of the grease, for example to undesired thinning of the grease.

It therefore has to be considered to be surprising that an addition of a composition which is liquid at 25° C. and comprises at least one polymeric structure improver is possible without significant change in the consistency.

This allows, inter alia, an improvement in various physical parameters, for example the water resistance of the lubricating grease measured to ASTM D 4049, to be achieved. For the user, this means that he or she comprises a grease with improved properties by simply mixing small amounts of structure-modified polymers. For the user, this means higher flexibility (building block system) and cost savings. In the process according to the invention, polymeric structure improvers are added to a dispersion. Polymeric structure improvers are known per se. These polymers lead in many cases to an improvement in the water resistance. It is assumed here that these polymers enter into physicochemical interaction with the thickeners, for example the soap molecules.

Preferred polymeric structure improvers lead to an improvement in the water resistance of at least 5% if they are present in a dispersion in an amount of 1% by weight based on the total weight. This improvement is based on the water resistance of this dispersion without polymeric structure improvers.

The polymeric structure improvers generally have a weight-average molecular weight in the range from 10 000 to 10 000 000 g/mol, preferably 15 000 to 1 000 000 g/mol and more preferably 20 000 to 500 000 g/mol. This parameter can be determined in a known manner by gel permeation chromatography.

The polymeric structure improvers include in particular polymers which are derived from olefinic esters, polyolefin copolymers (OCPs) and hydrogenated styrene-diene copolymers (HSDs).

Polymers which are usable as structure improvers and are derived from olefinic esters are known in the technical field and commercially available. Particularly preferred polymers of this class may be obtained by polymerization of monomer compositions which may in particular comprise (meth)acrylates, maleates and/or fumarates, which may have different alcohol radicals.

The expression (meth)acrylates encompasses methacrylates and acrylates and mixtures of the two. These monomers are widely known. The alkyl radical may be linear, cyclic or branched.

Mixtures from which preferred polymeric structure improvers are obtainable may contain 0 to 40% by weight, in particular 0.5 to 20% by weight, based on the weight of the monomer compositions for preparing the polymeric structure improvers, of one or more ethylenically unsaturated ester compounds of the formula (I)

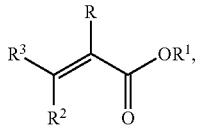

(I)

where R is hydrogen or methyl, $R^1$ is a linear or branched alkyl radical having 1 to 5 carbon atoms, $R^2$ and $R^3$ are each independently hydrogen or a group of the formula —COOR' where R' is hydrogen or an alkyl group having 1 to 5 carbon atoms.

Examples of component a) include

- (meth)acrylates, fumarates and maleates which derive from saturated alcohols, such as methyl(meth)acrylate, ethyl (meth)acrylate, n-propyl(meth)acrylate, isopropyl(meth) acrylate, n-butyl(meth)acrylate, tert-butyl (meth)acrylate and pentyl(meth)acrylate;
- cycloalkyl(meth)acrylates such as cyclopentyl (meth)acrylate;
- (meth)acrylates which derive from unsaturated alcohols, such as 2-propynyl(meth)acrylate, allyl(meth)acrylate and vinyl(meth)acrylate.

As a further constituent, the compositions to be polymerized to prepare preferred polymeric structure improvers may contain 50 to 100% by weight, in particular 55 to 95% by weight, based on the weight of the monomer compositions for preparing the polymeric structure improver, of one or more ethylenically unsaturated ester compounds of the formula (II)

(II)

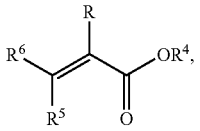

where R is hydrogen or methyl, $R^4$ is a linear or branched alkyl radical having from 6 to 30 carbon atoms, $R^5$ and $R^6$ are each independently hydrogen or a group of the formula —COOR" where R" is hydrogen or an alkyl group having 6 to 30 carbon atoms.

These include (meth)acrylates, fumarates and maleates which derive from saturated alcohols, such as hexyl(meth)acrylate, 2-ethylhexyl(meth)acrylate, heptyl(meth)acrylate, 2-tert-butylheptyl(meth)acrylate, octyl(meth)acrylate, 3-isopropylheptyl(meth)acrylate, nonyl(meth)acrylate, decyl(meth)acrylate, undecyl(meth)acrylate, 5-methyl-undecyl (meth)acrylate, dodecyl(meth)acrylate, 2-methyldodecyl(meth)acrylate, tridecyl(meth)-acrylate, 5-methyltridecyl(meth)acrylate, tetradecyl (meth)acrylate, pentadecyl(meth)acrylate, hexadecyl (meth)acrylate, 2-methylhexadecyl (meth)acrylate, heptadecyl(meth)acrylate, 5-isopropylheptadecyl (meth)acrylate, 4-tert-butyloctadecyl(meth)acrylate, 5-ethyloctadecyl(meth)acrylate, 3-isopropyloctadecyl (meth)acrylate, octadecyl(meth)acrylate, nonadecyl (meth)acrylate, eicosyl(meth)acrylate, cetyleicosyl (meth)acrylate, stearyleicosyl(meth)acrylate, docosyl (meth)acrylate and/or eicosyltetratriacontyl(meth)-acrylate;

cycloalkyl(meth)acrylates such as 2,4,5-tri-t-butyl-3-vinylcyclohexyl(meth)acrylate, 2,3,4,5-tetra-t-butylcyclohexyl (meth)acrylate;

(meth)acrylates which derive from unsaturated alcohols, for example oleyl(meth)acrylate;

cycloalkyl(meth)acrylates such as 3-vinylcyclohexyl (meth) acrylate, cyclohexyl(meth)acrylate, bornyl (meth)acrylate; and the corresponding fumarates and maleates.

The (meth)acrylates with a long-chain alcohol radical, in particular the compounds as per component (b), can be obtained, for example, by reacting (meth)acrylates and/or the corresponding acids with long-chain fatty alcohols, which generally forms a mixture of esters, for example (meth)acrylates with various long-chain alcohol radicals. These fatty alcohols include Oxo Alcohol® 7911 and Oxo Alcohol® 7900, Oxo Alcohol® 1100 from Monsanto; Alphanol® 79 from ICI; Nafol® 1620, Alfol® 610 and Alfol® 810 from Sasol; Epal® 610 and Epal® 810 from Ethyl Corporation; Linevol® 79, Linevol® 911 and Dobanol® 25L from Shell AG; Lial 125 from Sasol; Dehydad® and Lorol® types from Cognis.

In a particular aspect of the present invention, the mixture for preparing preferred polymeric structure improvers has at least 60% by weight, preferably at least 70% by weight, based on the weight of the monomer compositions for preparing the polymeric structure improvers, of monomers of the formula (II).

Among the ethylenically unsaturated ester compounds, particular preference is given to the (meth)acrylates over the maleates and fumarates, i.e. $R^2$, $R^3$, $R^5$ and $R^6$ of formulae (I) and (II) are each hydrogen in particularly preferred embodiments. In general, preference is given to the methacrylates over the acrylates.

In a particular aspect of the present invention, preference is given to using mixtures of long-chain alkyl(meth)acrylates as per component b), the mixtures comprising at least one (meth)acrylate having 6 to 15 carbon atoms in the alcohol radical and at least one (meth)acrylate having 16 to 30 carbon atoms in the alcohol radical. The proportion of the (meth) acrylates having 6 to 15 carbon atoms in the alcohol radical is preferably in the range from 20 to 95% by weight, based on the weight of the monomer composition for preparing the polymeric structure improvers. The proportion of the (meth) acrylates having 16 to 30 carbon atoms in the alcohol radical is preferably in the range from 0.5 to 60% by weight, based on the weight of the monomer composition for preparing the polymeric structure improvers.

Component c) of the composition to be used to prepare preferred polymeric structure improvers comprises in particular ethylenically unsaturated monomers which can be copolymerized with the ethylenically unsaturated ester compounds of the formulae (I) and/or (II).

However, particularly suitable comonomers for polymerization according to the present invention are those which correspond to the formula:

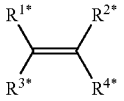

in which $R^{1*}$ and $R^{2*}$ are each independently selected from the group consisting of hydrogen, halogens, CN, linear or branched alkyl groups having 1 to 20, preferably from 1 to 6 and more preferably 1 to 4, carbon atoms which may be substituted by 1 to (2n+1) halogen atoms, where n is the number of carbon atoms of the alkyl group (for example $CF_3$), α,β-unsaturated linear or branched alkenyl or alkynyl groups having 2 to 10, preferably 2 to 6 and more preferably 2 to 4, carbon atoms which may be substituted by 1 to (2n−1) halogen atoms, preferably chlorine, where n is the number of carbon atoms of the alkyl group, for example $CH_2{=}CCl{-}$, cycloalkyl groups having 3 to 8 carbon atoms which may be substituted by 1 to (2n−1) halogen atoms, preferably chlorine, where n is the number of carbon atoms of the cycloalkyl group; aryl groups having 6 to 24 carbon atoms which may be substituted by 1 to (2n−1) halogen atoms, preferably chlorine, and/or alkyl groups having 1 to 6 carbon atoms, where n is the number of carbon atoms of the aryl group; $C({=}Y^*)R^{5*}$, $C({=}Y^*)NR^{6*}R^{7*}$, $Y^*C({=}Y^*)R^{5*}$, $SOR^{5*}$, $SO_2R^{5*}$, $OSO_2R^{5*}$, $NR^{8*}SO_2R^{5*}$, $PR^{5*}_2$, $P({=}Y^*)R^{5*}_2$, $Y^*PR^{5*}_2$, $Y^*P({=}Y^*)R^{5*}_2$, $NR^{8*}_2$ which may be quaternized with an additional $R^{8*}$, aryl or heterocyclyl group, where Y* may be $NR^{8*}$, S or O, preferably O; $R^{5*}$ is an alkyl group having 1 to 20 carbon atoms, an alkylthio having 1 to 20 carbon atoms, $OR^{15}$ ($R^{15}$ is hydrogen or an alkali metal), alkoxy of 1 to 20 carbon atoms, aryloxy or heterocyclyloxy; $R^{6*}$ and $R^{7*}$ are each independently hydrogen or an alkyl group having 1 to 20 carbon atoms, or $R^{6*}$ and $R^{7*}$ together may form an alkylene group having 2 to 7, preferably 2 to 5 carbon atoms, in which case they form a 3- to 8-membered, preferably 3- to 6-membered, ring, and $R^{8*}$ is hydrogen, linear or branched alkyl or aryl groups having 1 to 20 carbon atoms;

$R^{3*}$ and $R^{4*}$ are independently selected from the group consisting of hydrogen, halogen (preferably fluorine or chlorine), alkyl groups having 1 to 6 carbon atoms and $COOR^{9*}$ in which $R^{9*}$ is hydrogen, an alkali metal or an alkyl group having 1 to 40 carbon atoms, or $R^{1*}$ and $R^{3*}$ together may form a group of the formula $(CH_2)_n$, which may be substituted by 1 to 2n' halogen atoms or $C_1$ to $C_4$ alkyl groups, or form the formula C(=O)—Y*—C(=O) where n' is 2 to 6, preferably 3 or 4, and Y* is as defined above; and where at least 2 of the $R^{1}$*, $R^{2}$*, $R^{3}$* and $R^{4}$* radicals are hydrogen or halogen.

These include:

aryl(meth)acrylates such as benzyl methacrylate or phenyl methacrylate in which the aryl radicals may each be unsubstituted or up to tetrasubstituted;

methacrylates of halogenated alcohols, such as
2,3-dibromopropyl methacrylate,
4-bromophenyl methacrylate,
1,3-dichloro-2-propyl methacrylate,
2-bromoethyl methacrylate,
2-iodoethyl methacrylate,
chloromethyl methacrylate;

vinyl halides, for example vinyl chloride, vinyl fluoride, vinylidene chloride and vinylidene fluoride;

vinyl esters such as vinyl acetate;

styrene, substituted styrenes having an alkyl substitutent in the side chain, for example α-methyl-styrene and α-ethylstyrene, substituted styrenes having an alkyl substitutent on the ring, such as vinyltoluene and p-methylstyrene, halogenated styrenes, for example monochlorostyrenes, dichlorostyrenes, tribromostyrenes and tetrabromostyrenes;

heterocyclic vinyl compounds such as 2-vinylpyridine, 3-vinylpyridine, 2-methyl-5-vinylpyridine, 3-ethyl-4-vinylpyridine, 2,3-dimethyl-5-vinylpyridine, vinyl-pyrimidine, vinylpiperidine, 9-vinylcarbazole, 3-vinyl-carbazole, 4-vinylcarbazole, 1-vinylimidazole, 2-methyl-1-vinylimidazole, N-vinylpyrrolidone, 2-vinyl-pyrrolidone, N-vinylpyrrolidine, 3-vinylpyrrolidine, N-vinylcaprolactam, N-vinylbutyrolactam, vinyloxolane, vinylfuran, vinylthiophene, vinylthiolane, vinylthiazoles and hydrogenated vinylthiazoles, vinyloxazoles and hydrogenated vinyloxazoles;

vinyl and isoprenyl ethers;

maleic acid and maleic acid derivatives, for example
maleic anhydride, methylmaleic anhydride, maleimide, methylmaleimide;

fumaric acid and fumaric acid derivatives;

acrylic acid and (meth)acrylic acid;

dienes, for example divinylbenzene.

More preferably, the compositions for preparing preferred structure improvers comprise monomers which can be represented by the formula (III)

(III)

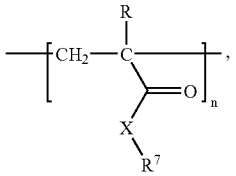

where R is independently hydrogen or methyl, $R^{7}$ is independently a group which comprises 2 to 1000 carbon atoms and has at least one heteroatom, X is independently a sulphur or oxygen atom or a group of the formula $NR^{11}$ where $R^{11}$ is independently hydrogen or a group having 1 to 20 carbon atoms, and n is an integer greater than or equal to 3.

The $R^{7}$ radical is a group comprising 2 to 1000, in particular 2 to 100, preferably 2 to 20 carbon atoms. The term "group having 2 to 1000 carbon" denotes radicals of organic compounds having 2 to 1000 carbon atoms. It encompasses aromatic and heteroaromatic groups, and also alkyl, cycloalkyl, alkoxy, cycloalkoxy, alkenyl, alkanoyl, alkoxycarbonyl groups, and also heteroaliphatic groups. The groups mentioned may be branched or unbranched. In addition, these groups may have customary substitutents.

Substituents are, for example, linear and branched alkyl groups having 1 to 6 carbon atoms, for example methyl, ethyl, propyl, butyl, pentyl, 2-methylbutyl or hexyl; cycloalkyl groups, for example cyclopentyl and cyclohexyl; aromatic groups such as phenyl or naphthyl; amino groups, ether groups, ester groups and halides.

According to the invention, aromatic groups denote radicals of mono- or polycyclic aromatic compounds having preferably 6 to 20, in particular 6 to 12, carbon atoms. Heteroaromatic groups denote aryl radicals in which at least one CH group has been replaced by N and/or at least two adjacent CH groups have been replaced by S, NH or O, heteroaromatic groups having 3 to 19 carbon atoms.

Aromatic or heteroaromatic groups preferred in accordance with the invention derive from benzene, naphthalene, biphenyl, diphenyl ether, diphenylmethane, diphenyldimethylmethane, bisphenone, diphenylsulphone, thiophene, furan, pyrrole, thiazole, oxazole, imidazole, isothiazole, isoxazole, pyrazole, 1,3,4-oxadiazole, 2,5-diphenyl-1,3,4-oxadiazole, 1,3,4-thiadiazole, 1,3,4-triazole, 2,5-diphenyl-1,3,4-triazole, 1,2,5-triphenyl-1,3,4-triazole, 1,2,4-oxadiazole, 1,2,4-thiadiazole, 1,2,4-triazole, 1,2,3-triazole, 1,2,3,4-tetrazole, benzo[b]thiophene, benzo[b]furan, indole, benzo[c]thiophene, benzo[c]furan, isoindole, benzoxazole, benzothiazole, benzimidazole, benzisoxazole, benzisothiazole, benzopyrazole, benzothiadiazole, benzotriazole, dibenzofuran, dibenzothiophene, carbazole, pyridine, bipyridine, pyrazine, pyrazole, pyrimidine, pyridazine, 1,3,5-triazine, 1,2,4-triazine, 1,2,4,5-triazine, tetrazine, quinoline, isoquinoline, quinoxaline, quinazoline, cinnoline, 1,8-naphthyridine, 1,5-naphthyridine, 1,6-naphthyridine, 1,7-naphthyridine, phthalazine, pyridopyrimidine, purine, pteridine or quinolizine, 4H-quinolizine, diphenyl ether, anthracene, benzopyrrole, benzooxathiadiazole, benzooxadiazole, benzopyridine, benzopyrazine, benzopyrazidine, benzopyrimidine, benzotriazine, indolizine, pyridopyridine, imidazopyrimidine, pyrazinopyrimidine, carbazole, aciridine, phenazine, benzoquinoline, phenoxazine, phenothiazine, acridizine, benzopteridine, phenanthroline and phenanthrene, each of which may also optionally be substituted.

The preferred alkyl groups include the methyl, ethyl, propyl, isopropyl, 1-butyl, 2-butyl, 2-methylpropyl, tert-butyl radical, pentyl, 2-methylbutyl, 1,1-dimethylpropyl, hexyl, heptyl, octyl, 1,1,3,3-tetra-methylbutyl, nonyl, 1-decyl, 2-decyl, undecyl, dodecyl, pentadecyl and the eicosyl group.

The preferred cycloalkyl groups include the cyclopropyl, cyclobutyl, cyclopentyl, cyclohexyl, cycloheptyl and the cyclooctyl group, each of which is optionally substituted with branched or unbranched alkyl groups.

The preferred alkenyl groups include the vinyl, allyl, 2-methyl-2-propenyl, 2-butenyl, 2-pentenyl, 2-decenyl and the 2-eicosenyl group.

The preferred alkynyl groups include the ethynyl, propargyl, 2-methyl-2-propynyl, 2-butynyl, 2-pentynyl and the 2-decynyl group.

The preferred alkanoyl groups include the formyl, acetyl, propionyl, 2-methylpropionyl, butyryl, valeryl, pivaloyl, hexanoyl, decanoyl and the dodecanoyl group.

The preferred alkoxycarbonyl groups include the methoxycarbonyl, ethoxycarbonyl, propoxycarbonyl, butoxycarbonyl, tert-butoxycarbonyl, hexyloxycarbonyl, 2-methylhexyloxycarbonyl, decyloxycarbonyl or dodecyloxycarbonyl group.

The preferred alkoxy groups include alkoxy groups whose hydrocarbon radical is one of the aforementioned preferred alkyl groups.

The preferred cycloalkoxy groups include cycloalkoxy groups whose hydrocarbon radical is one of the aforementioned preferred cycloalkyl groups.

The preferred heteroatoms which are present in the $R^{10}$ radical include oxygen, nitrogen, sulphur, boron, silicon and phosphorus.

In a particular embodiment of the present invention, the $R^7$ radical in formula (III) has at least one group of the formula —OH or —$NR^8R^8$, in which $R^8$ independently includes hydrogen or a group having 1 to 20 carbon atoms.

The X group in formula (III) can preferably be represented by the formula NH.

The numerical ratio of heteroatoms to carbon atoms in the $R^7$ radical of the formula (III) may lie within wide ranges. This ratio is preferably in the range from 1:1 to 1:10, in particular 1:1 to 1:5 and more preferably 1:2 to 1:4.

The $R^7$ radical of the formula (III) comprises 2 to 1000 carbon atoms. In a particular aspect, the $R^7$ radical has at most 10 carbon atoms.

The preferred comonomers include hydroxyalkyl(meth)acrylates such as
3-hydroxypropyl methacrylate,
3,4-dihydroxybutyl methacrylate,
2-hydroxyethyl methacrylate,
2-hydroxypropyl methacrylate,
2,5-dimethyl-1,6-hexanediol (meth)acrylate,
1,10-decanediol (meth)acrylate, carbonyl-containing methacrylates such as
2-carboxyethyl methacrylate,
carboxymethyl methacrylate,
oxazolidinylethyl methacrylate,
N-(methacryloyloxy)formamide,
acetonyl methacrylate,
N-methacryloylmorpholine,
N-methacryloyl-2-pyrrolidinone,
N-(2-methacryloyloxyethyl)-2-pyrrolidinone,
N-(3-methacryloyloxypropyl)-2-pyrrolidinone,
N-(2-methacryloyloxypentadecyl)-2-pyrrolidinone,
N-(3-methacryloyloxyheptadecyl)-2-pyrrolidinone;

glycol dimethacrylates such as 1,4-butanediol methacrylate, 2-butoxyethyl methacrylate, 2-ethoxyethoxymethyl methacrylate,
2-ethoxyethyl methacrylate;

methacrylates of ether alcohols, such as
tetrahydrofurfuryl methacrylate,
vinyloxyethoxyethyl methacrylate,
methoxyethoxyethyl methacrylate,
1-butoxypropyl methacrylate,
1-methyl-(2-vinyloxy)ethyl methacrylate,
cyclohexyloxymethyl methacrylate,
methoxymethoxyethyl methacrylate,
benzyloxymethyl methacrylate,
furfuryl methacrylate,
2-butoxyethyl methacrylate,
2-ethoxyethoxymethyl methacrylate,
2-ethoxyethyl methacrylate,
allyloxymethyl methacrylate,
1-ethoxybutyl methacrylate,
methoxymethyl methacrylate,
1-ethoxyethyl methacrylate, ethoxymethyl methacrylate and ethoxylated (meth)acrylates which have preferably 1 to 20, in particular 2 to 8, ethoxy groups;

aminoalkyl(meth)acrylates and aminoalkyl(meth)-acrylatamides, such as N-(3-dimethylaminopropyl)methacrylamide,
dimethylaminopropyl methacrylate,
3-diethylaminopentyl methacrylate,
3-dibutylaminohexadecyl(meth)acrylate;

nitriles of (meth)acrylic acid and other nitrogen-containing methacrylates, such as
N-(methacryloyloxyethyl)diisobutyl ketimine,
N-(methacryloyloxyethyl)dihexadecyl ketimine, methacryloylamidoacetonitrile,
2-methacryloyloxyethylmethylcyanamide, cyanomethyl methacrylate;

heterocyclic (meth)acrylates such as 2-(1-imidazolyl)-ethyl (meth)acrylate, 2-(4-morpholinyl)ethyl(meth)-acrylate and 1-(2-methacryloyloxyethyl)-2-pyrrolidone;

oxiranyl methacrylates such as
2,3-epoxybutyl methacrylate, 3,4-epoxybutyl methacrylate, 10,11-epoxyundecyl methacrylate, 2,3-epoxycyclohexyl methacrylate, 10,11-epoxyhexadecyl methacrylate;

glycidyl methacrylate;

sulphur-containing methacrylates such as
ethylsulphinylethyl methacrylate, 4-thiocyanatobutyl methacrylate, ethylsulphonylethyl methacrylate, thiocyanatomethyl methacrylate, methylsulphinylmethyl methacrylate, bis(methacryloyloxyethyl)sulphide;

phosphorus-, boron- and/or silicon-containing meth-acrylates such as
2-(dimethylphosphato)propyl methacrylate, 2-(ethylenephosphito)propyl methacrylate, dimethylphosphinomethyl methacrylate, dimethylphosphonoethyl methacrylate, diethylmethacryloyl phosphonate, dipropylmethacryloyl phosphate, 2-(dibutylphosphono)-ethyl methacrylate, 2,3-butylenemethacryloylethyl borate, methyldiethoxymethacryloylethoxysilane, diethylphosphatoethyl methacrylate.

These monomers may be used individually or as a mixture.

The ethoxylated (meth)acrylates can be obtained, for example, by transesterification of alkyl(meth)-acrylates with ethoxylated alcohols which more preferably have 1 to 20, in particular 2 to 8 ethoxy groups. The hydrophobic radical of the ethoxylated alcohols may preferably comprise 1 to 40, in particular 4 to 22 carbon atoms, and either linear or branched alcohol radicals may be used. In a further preferred embodiment, the ethoxylated (meth)acrylates have an OH end group.

Examples of commercially available ethoxylates which can be employed for the preparation of ethoxylated (meth) acrylates are ethers of the Lutensol® A brands, in particular Lutensol® A 3 N, Lutensol® A 4 N, Lutensol® A 7 N and Lutensol® A 8 N, ethers of the Lutensol® TO brands, in particular Lutensol® TO 2, Lutensol® TO 3, Lutensol® TO 5, Lutensol® TO 6, Lutensol® TO 65, Lutensol® TO 69, Lutensol® TO 7, Lutensol® TO 79, Lutensol® 8 and Lutensol® 89, ethers of the Lutensol® AO brands, in particular Lutensol® & AO 3, Lutensol® AO 4, Lutensol® AO 5, Lutensol® AO 6, Lutensol® AO 7, Lutensol® AO 79, Lutensol® AO 8 and Lutensol® AO 89, ethers of the Lutensol® ON brands, in particular Lutensol® ON 30, Lutensol® ON 50, Lutensol® ON 60, Lutensol® ON, 65, Lutensol® ON 66, Lutensol® ON 70, Lutensol® ON 79 and Lutensol® ON 80, ethers of the Lutensol® XL brands, in particular Lutensol® XL 300, Lutensol® XL 400, Lutensol® XL 500, Lutensol® XL 600, Lutensol® XL 700, Lutensol® XL 800, Lutensol® XL 900 and Lutensol® XL 1000, ethers of the Lutensol® AP brands, in particular Lutensol® AP 6, Lutensol® AP 7, Lutensol® AP 8, Lutensol® AP 9, Lutensol® AP 10, Lutensol® AP 14 and Lutensol® AP 20, ethers of the IMBENTIN® brands, in particular of the IMBENTIN® AG brands, of the IMBENTIN® U brands, of the IMBENTIN® C brands, of the IMBENTIN® T brands, of the IMBENTIN® OA brands, of the IMBENTIN® POA brands, of the IMBENTIN® N brands and of the IMBENTIN® 0 brands and ethers of the Marlipal® brands, in particular Marlipal® 1/7, Marlipal® 1012/6, Marlipal® 1618/1, Marlipal® 24/20, Marlipal® 24/30, Marlipal® 24/40, Marlipal® 013/20, Marlipal® 013/30, Marlipal® 013/40, Marlipal® 025/30, Marlipal® 025/70, Marlipal® 045/30, Marlipal® 045/40, Marlipal® 045/50, Marlipal® 045/70 and Marlipal® 045/80.

Among these, particular preference is given to aminoalkyl (meth)acrylates and aminoalkyl(meth)-acrylamides, for example N-(3-dimethylaminopropyl)-methacrylamide (DMAPMAM), and hydroxyalkyl(meth)-acrylates, for example 2-hydroxyethyl methacrylate (HEMA).

Very particularly preferred mixtures for preparing the polymeric structure improvers comprise methyl methacrylate, butyl methacrylate, lauryl methacrylate, stearyl methacrylate and/or styrene.

In a particular aspect of the invention, component c) of the composition to be used to prepare preferred polymeric structure improvers comprises in particular monomers comprising acid groups or salts thereof.

Preferred salts are in particular the alkali metal salts, for example the lithium, sodium and/or potassium salts; the alkaline earth metal salts, for example the calcium and/or barium salts, and also the aluminium salts.

The proportion of monomers comprising acid groups or salts thereof in components c) is generally 0.01 to 20% by weight, preferably 0.1 to 10% by weight and more preferably 0.5 to 5% by weight, based on the weight of the monomer compositions for preparing the polymeric structure improvers.

Monomers comprising acid groups are known in the technical field. These can be represented in many cases by the formula (IV)

(IV)

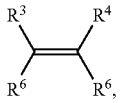

where $R^3$ and $R^4$ are each independently selected from the group consisting of hydrogen, halogens, CN, linear or branched alkyl groups having 1 to 20, preferably 1 to 6 and more preferably 1 to 4 carbon atoms, which may be substituted by 1 to (2n+1) halogen atoms where n is the number of carbon atoms of the alkyl group (for example $CF_3$), α,β-unsaturated linear or branched alkenyl or alkynyl groups having 2 to 10, preferably 2 to 6 and more preferably 2 to 4 carbon atoms, which may be substituted by 1 to (2n−1) halogen atoms, preferably chlorine, where n is the number of carbon atoms of the alkyl group, for example $CH_2{=}CCl{-}$, cycloalkyl groups having 3 to 8 carbon atoms which may be substituted by 1 to (2n−1) halogen atoms, preferably chlorine, where n is the number of carbon atoms of the cycloalkyl group; aryl groups having 6 to 24 carbon atoms which may be substituted by 1 to (2n−1) halogen atoms, preferably chlorine, and/or alkyl groups having 1 to 6 carbon atoms, where n is the number of carbon atoms of the aryl group; $COOR^7$, $-SO_3R^7$ and/or $PO_3R^7{}_2$ where $R^7$ is independently hydrogen, an alkali metal, an alkaline earth metal and/or aluminium, an ammonium group having up to 20 carbon atoms or an alkyl group having 1 to 40 carbon atoms;

$R^5$ and $R^6$ are each independently selected from the group consisting of hydrogen, halogen (preferably fluorine or chlorine), alkyl groups having 1 to 6 carbon atoms and $COOR^7$, $-SO_3R^7$ and/or $PO_3R^7{}_2$ where $R^7$ is independently hydrogen, an alkali metal, an ammonium group having up to 20 carbon atoms or an alkyl group having 1 to 40 carbon atoms, where $R^7$ is hydrogen, an alkali metal, an alkaline earth metal and/or aluminium or an alkyl group having 1 to 40 carbon atoms, or $R^5$ and $R^6$ may together form a group of the formula $(CH_2)_{n'}$, which may be substituted by 1 to 2n' halogen atoms or $C_1$ to $C_4$ alkyl groups, or form the formula $C(=O)-Y-C(=O)$, where n' is 2 to 6, preferably 3 or 4, and Y may be $NR^8$, S or O, preferably O, where $R^8$ is hydrogen, linear or branched alkyl or aryl groups having 1 to 20 carbon atoms; where at least two of the $R^3$, $R^4$, $R^5$ and $R^6$ radicals are each hydrogen or halogen and at least one of the $R^3$, $R^4$, $R^5$ and $R^6$ radicals comprises at least one group of the formula $-COOM$, $-SO_3M$ and/or $PO_3M_2$, where M is independently hydrogen, an alkali metal, an alkaline earth metal and/or aluminium.

These include ethylenically unsaturated compounds, for example vinylsulphonic acid, vinylphosphonic acid, acrylic acid, methacrylic acid, fumaric acid, monoesters of fumaric acid, where the alcohol radical may comprise generally 1 to 30 carbon atoms, maleic acid, monoesters of maleic acid, where the alcohol radical may comprise-generally 1 to 30 carbon atoms, vinylbenzoic acid and sulphonated styrenes such as styrenesulphonic acid. In addition, the salts derived from these acids, in particular the alkali metal, alkaline earth metal and/or aluminium salts, may be used.

These components may be used individually or as mixtures.

The preferred polymeric structure improvers which may be obtained by polymerizing unsaturated ester compounds generally have a molecular weight in the range from 10 000 to 1 000 000 g/mol, preferably in the range from $15\times10^3$ to $500\times10^3$ g/mol and more preferably in the range from $20\times10^3$ to $300\times10^3$ g/mol, without any intention that this should impose a restriction. These values relate to the weight-average molecular weight of the polydisperse polymers in the composition.

The preparation of the polymeric structure improvers from the above-described compositions is known per se. For instance, these polymers can be effected especially by free-radical polymerization, and also related processes, for example ATRP (=Atom Transfer Radical Polymerization) or RAFT (=Reversible Addition Fragmentation Chain Transfer).

The customary free-radical polymerization is explained, inter alia, in Ullmanns's Encyclopedia of Industrial Chemistry, Sixth Edition. In general, a polymerization initiator is used for this purpose.

These include the azo initiators well known in the technical field, such as AIBN and 1,1-azo-biscyclohexanecarbonitrile, and also peroxy compounds such as methyl ethyl ketone peroxide, acetylacetone peroxide, dilauryl peroxide, tert-butyl per-2-ethyl-hexanoate, ketone peroxide, tert-butyl peroctoate, methyl isobutyl ketone peroxide, cyclohexanone peroxide, dibenzoyl peroxide, tert-butyl peroxy-benzoate, tert-butyl peroxyisopropylcarbonate, 2,5-bis-(2-ethylhexanoylperoxy)-2,5-dimethylhexane, tert-butyl peroxy-2-ethylhexanoate, tert-butyl peroxy-3,5,5-tri-methylhexanoate, dicumyl peroxide, 1,1-bis(tert-butyl-peroxy)cyclohexane, 1,1-bis(tert-butylperoxy)-3,3,5-trimethylcyclohexane, cumyl hydroperoxide, tert-butyl hydroperoxide, bis(4-tert-butylcyclohexyl)peroxydicarbonate, mixtures of two or more of the aforementioned compounds with one another, and also mixtures of the aforementioned compounds with compounds which have not been mentioned and can likewise form free radicals.

The ATRP process is known per se. It is assumed that it is a "living" free-radical polymerization, without any intention that this should restrict the description of the mechanism. In these processes, a transition metal compound is reacted with a compound which has a transferable atom group. This transfers the transferable atom group to the transition metal compound, which oxidizes the metal. This reaction forms a radical which adds onto ethylenic groups. However, the transfer of the atom group to the transition metal compound is reversible, so that the atom group is transferred back to the growing polymer chain, which forms a controlled polymerization system. The structure of the polymer, the molecular weight and the molecular weight distribution can be controlled correspondingly. This reaction is described, for example, by J-S. Wang, et al., J. Am. Chem. Soc., vol. 117, p. 5614-5615 (1995), by Matyjaszewski, Macromolecules, vol. 28, p. 7901-7910 (1995). In addition, the patent applications WO 96/30421, WO 97/47661, WO 97/18247, WO 98/40415 and WO 99/10387 disclose variants of the ATRP explained above.

In addition, the inventive polymers may be obtained, for example, also via RAFT methods. This process is presented in detail, for example, in WO 98/01478, to which reference is made explicitly for the purposes of disclosure.

The polymerization may be carried out at standard pressure, reduced pressure or elevated pressure. The polymerization temperature too is uncritical. However, it is generally in the range of −20°-200° C., preferably 0°-130° C. and more preferably 600-120° C.

The polymerization may be carried out with or without solvent. The term solvent is to be understood here in a broad sense.

The polymerization is preferably carried out in a nonpolar solvent. These include hydrocarbon solvents, for example aromatic solvents such as toluene, benzene and xylene, saturated hydrocarbons, for example cyclohexane, heptane, octane, nonane, decane, dodecane, which may also be present in branched form. These solvents may be used individually and as a mixture.

Particularly preferred solvents are mineral oils, natural oils and synthetic oils, and also mixtures thereof. Among these, very particular preference is given to mineral oils.

The polyolefin copolymers (OCP) usable in accordance with the invention are known per se. They are primarily polymers formed from ethylene, propylene, isoprene, butylene and/or further olefins having 5 to 20 carbon atoms. It is equally possible to use systems which are grafted with small amounts of oxygen- or nitrogen-containing monomers (for example 0.05 to 5% by weight of maleic anhydride). The copolymers which comprise diene components are generally hydrogenated in order to reduce the oxidation sensitivity and the crosslinking tendency of the polymers.

The molecular weight Mw is generally 10 000 to 300 000, preferably between 50 000 and 150 000. Such olefin copolymers are described, for example, in the German published specifications DE-A 16 44 941, DE-A 17 69 834, DE-A 19 39 037, DE-A 19 63 039 and DE-A 20 59 981.

Ethylene-propylene copolymers are particularly useful, as are terpolymers with the known "ter" components, such as ethylidene-norbornene (cf. Macromolecular Reviews, Vol. 10 (1975)), but their tendency to crosslink in the course of the ageing process needs to be taken into account. The distribution may be substantially random, but it is also possible advantageously to employ sequence polymers with ethylene blocks. The ratio of the ethylene-propylene monomers is variable within certain limits, which may be set at about 75% for ethylene and about 80% for propylene as the upper limit owing to its reduced tendency to solubility in oil, polypropylene is already less suited than ethylene-propylene copolymers. In addition to polymers with predominantly atactic propylene incorporation, it is also possible to use those having more marked iso- or syndiotactic propylene incorporation.

Such products are commercially available, for example, under the tradenames Dutral® CO 034, Dutral® CO 038, Dutral® CO 043, Dutral® CO 058, Buna® EPG 2050 or Buna® EPG 5050.

The hydrogenated styrene-diene copolymers (HSD) are likewise known, these polymers being described, for example, in DE 21 56 122. They are generally hydrogenated isoprene- or butadiene-styrene copolymers. The ratio of diene to styrene is preferably in the range from 2:1 to 1:2, more preferably approx. 55:45. The molecular weight Mw is generally 10 000 to 300 000, preferably between 50 000 and 150 000. The fraction of the double bonds after the hydrogenation is, in a particular aspect of the present invention, at most 15%, more preferably at most 5%, based on the number of double bonds before the hydrogenation.

Hydrogenated styrene-diene copolymers may be obtained commercially under the tradenames ®SHELLVIS 50, 150, 200, 250 or 260.

The polymeric structure improvers may be random copolymers. In addition, these polymers may be graft polymers and/or block copolymers.

In a particular aspect of the present invention, a polymeric structure improver obtainable by graft polymerization is used in the composition liquid at 25° C., in which case a composition comprising components a) to c) is polymerized onto a graft base which comprises an olefin copolymer (OCP) which has been formed predominantly from ethylene and propylene and/or a hydrogenated copolymer (HSD) formed from dienes and styrene. These polymers have been described above.

The polymeric structure improvers are added to the dispersion in a liquid composition. The composition may be either a dispersion or a solution. Accordingly, these compositions comprise at least one liquid medium.

Liquid media for dispersing or dissolving the above-described polymeric structure improvers are known per se, and these media should be compatible with the dispersion which comprises at least one thickener and at least one lubricating oil. Compatibility is understood here to mean the miscibility of the medium with the dispersion which comprises at least one thickener and at least one lubricating oil.

The preferred media include in particular lubricating oils, which may likewise be used to prepare the dispersion which comprises at least one thickener and at least one lubricating oil.

The lubricating oils include especially mineral oils, synthetic oils and natural oils.

Mineral oils are known per se and commercially available. They are generally obtained from petroleum or crude oil by distillation and/or refining and optionally further purification and finishing processes, the term mineral oil including in particular the higher-boiling fractions of crude oil or petroleum. In general, the boiling point of mineral oil is higher than 200° C., preferably higher than 300° C., at 5000 Pa. The production by low-temperature carbonization of shale oil, coking of bituminous coal, distillation of brown coal with exclusion of air, and also hydrogenation of bituminous or brown coal is likewise possible. Mineral oils are also produced in a smaller proportion from raw materials of vegetable (for example from jojoba, rapeseed) or animal (for example neatsfoot oil) origin. Accordingly, mineral oils have, depending on their origin, different proportions of aromatic, cyclic, branched and linear hydrocarbons.

In general, a distinction is drawn between paraffin-base, naphthenic and aromatic fractions in crude oils or mineral oils, in which the term paraffin-base fraction represents longer-chain or highly branched isoalkanes, and naphthenic fraction represents cycloalkanes. In addition, mineral oils, depending on their origin and finishing, have different fractions of n-alkanes, isoalkanes having a low degree of branching, known as mono-methyl-branched paraffins, and compounds having heteroatoms, in particular O, N and/or S, to which a degree of polar properties is attributed. However, the assignment is difficult, since individual alkane molecules may have both long-chain branched groups and cycloalkane radicals, and aromatic parts. For the purposes of the present invention, the assignment can be effected to DIN 51 378, for example. Polar fractions can also be determined to ASTM D 2007. The fraction of n-alkanes in preferred mineral oils is less than 3% by weight, the fraction of O-, N- and/or S-containing compounds less than 6% by weight. The fraction of the aromatics and of the mono-methyl-branched paraffins is generally in each case in the range from 0 to 40% by weight. In one interesting aspect, mineral oil comprises mainly naphthenic and paraffin-base alkanes which have generally more than 13, preferably more than 18 and most preferably more than 20 carbon atoms. The fraction of these compounds is generally >60% by weight, preferably >80% by weight, without any intention that this should impose a restriction. A preferred mineral oil contains 0.5 to 30% by weight of aromatic fractions, 15 to 40% by weight of naphthenic fractions, 35 to 80% by weight of paraffin-base fractions, up to 3% by weight of n-alkanes and 0.05 to 5% by weight of polar compounds, based in each case on the total weight of the mineral oil.

An analysis of particularly preferred mineral oils, which was effected by means of conventional processes such as urea separation and liquid chromatography on silica gel, shows, for example, the following constituents, the percentages relating to the total weight of the particular mineral oil used:

n-alkanes having approx. 18 to 31 carbon atoms:
0.7-1.0%,
slightly branched alkanes having 18 to 31 carbon atoms:
1.0-8.0%,
aromatics having 14 to 32 carbon atoms:
0.4-10.7%,
iso- and cycloalkanes having 20 to 32 carbon atoms:
60.7-82.4%,
polar compounds:
0.1-0.8%,
loss:
6.9-19.4%.

Valuable information with regard to the analysis of mineral oils and a list of mineral oils which have a different composition can be found, for example, in Ullmann's Encyclopedia of Industrial Chemistry, 5th Edition on CD-ROM, 1997, under "lubricants and related products".

Synthetic oils include organic esters, for example diesters and polyesters, polyalkylene glycols, polyethers, synthetic hydrocarbons, especially polyolefins, among which preference is given to polyalphaolefins (PAO), silicone oils and perfluoroalkyl ethers. They are usually somewhat more expensive than the mineral oils, but have advantages with regard to their performance.

Natural oils are animal or vegetable oils, for example neatsfoot oils or jojoba oils.

These lubricating oils may also be used as mixtures and are in many cases commercially available.

In a particular aspect of the present invention, the composition which is liquid at 25° C. and comprises at least one polymeric structure improver has a viscosity at 25° C. in the range from 0.01 $mm^2/s$ to 100 000 $mm^2/s$, preferably 0.1 $mm^2/s$ to 200 000 $mm^2/s$ and more preferably 1 $mm^2/s$ to 10 000 $mm^2/s$, according to DIN 51562.

The concentration of the polymeric structure improver in the composition liquid at 25° C. is preferably in the range from 1 to 99% by weight, more preferably in the range from 5 to 89% by weight and most preferably in the range from 10 to 80% by weight, based on the total weight of the composition.

The composition liquid at 25° C. is added to a dispersion which has grease structure and comprises at least one thickener and at least one lubricating oil.

The term "grease structure" is known in the technical field, and this structure can be referred to as sponge-like. The structure of the dispersion can be detected, for example, by microscopic images, the lubricating oil being kept in a thickener.

The lubricating oil component has been described above as a medium for the polymeric structure improvers, which include in particular mineral oils, synthetic oils and natural oils.

The thickeners are known per se in the technical field and can be obtained commercially. These are, inter alia, in Ullmann's Encyclopedia of Industrial Chemistry, Sixth Edition, Vol. 20, 2003, Wiley, ISBN 3-527-30385-5, in T. Mang and W. Dresel, Lubricants and Lubrication, 2001, Wiley, ISBN 3-527-29536-4, and Wilfried J. Bartz et al., Schmierfette, expert-Verl., 2000, ISBN 3-8169-1533-7. These include in particular soap thickeners, inorganic thickeners and polymeric thickeners.

The soap thickeners comprise generally at least one metal component and at least one carboxylic acid anion component.

The customary metal components include in particular the alkali metals such as lithium, sodium and potassium, the alkaline earth metals such as calcium or barium, and aluminium.

The carboxylic acid anion component comprises generally anions which are derived from long-chain carboxylic acids which in many cases have 6 to 30 carbon atoms. These include in particular stearic acid, 12-hydroxy-stearic acid, octadecanoic acid, eicosanoic acid and hexadecanoic acid.

In addition, the carboxylic acid anion component may comprise anions which are derived from short-chain carboxylic acids having 1 to 6 carbon atoms or from aromatic carboxylic acids. These include in particular acetic acid, propanoic acid and butanoic acid, and also benzoic acid.

The soap thickeners may be used as such in the process in order to produce a dispersion comprising grease structure. In addition, they may also be prepared in situ from the corresponding acids or their derivatives, for example their esters, and basic metal compounds.

The preferred acids have been detailed above. With regard to the esters, it should be emphasized that preference is given to esters having a short-chain alcohol radical having 1 to 6 carbon atoms, for example the methyl, ethyl, propyl and/or butyl esters.

The preferred basic compounds include in particular the oxides, hydroxides and carbonates of the aforementioned metals.

The preferred soap thickeners include lithium 12-hydroxystearate, lithium complex soaps, aluminium complex soaps and calcium complex soaps.

Furthermore, the basic compounds may also be added in an excess or deficiency for the preparation of the soaps to form underbased or overbased compounds.

Furthermore, inorganic thickeners can be used. These include in particular organophilic clays which may be derived from bentonite, and silica gel.

In addition, it is also possible to use polymeric thickeners. These include polyureas and thermoplastic powders such as polytetrafluoroethylene and fluoro-ethylenepropylene.

The weight ratio of lubricating oil to thickener in the dispersion comprising grease structure is known per se and is described in the literature mentioned above. In general, this ratio is in the range from 100:1 to 100:30, preferably 100:2 to 100:25, in particular 100:5 to 100:15.

In addition to the aforementioned components, the liquid composition comprising at least one polymeric structure improver and/or the dispersion which comprises at least one thickener and at least one lubricating oil may comprise further additives.

These additives include viscosity index improvers, antioxidants, ageing protectants, wear protectants, corrosion inhibitors, detergents, dispersants, EP additives, friction modifiers, dyes, odourants, metal deactivators and/or demulsifiers.

The production of dispersions which have grease structure from the aforementioned components is known per se and is described, for example, in the introductory prior art.

In a structure formation phase, the lubricating grease structure or lubricating grease matrix is obtained by physicochemical processes. In the course of this, various processes proceed, for example the aggregation of the thickener crystals, the formation of soap micelles by intercalation and adsorption of base oil molecules, the commencement of melting of the soap micelles (=heating above the melting point of the soap molecules) and finally the recrystallization of the soap molecules (=controlled cooling).

In many cases, a metal soap is obtained from precursors in a first stage. In the reaction phase, metal soap molecules are obtained by reaction of the corresponding starting materials in the base oil. The metal soap molecules are present in the form of fine crystals. This stage is optional, since it is not necessary by virtue of selection of appropriate precursor compounds.

The ratio of the weight of the dispersion to the weight of the composition which is liquid at 25° C. and comprises at least one polymeric structure improver is preferably in the range from 100:1 to 1:1, more preferably in the range from 50:1 to 5:1 and most preferably in the range from 25:1 to 10:1.

The composition liquid at 25° C. can be added, inter alia, during a mechanical phase which follows the structure formation phase.

In addition, the composition liquid at 25° C. can be added to a finished lubricating grease after the mechanical phase. By virtue of this particular aspect of the present invention, it is possible, for example, to produce a large amount of a simple lubricating grease which can subsequently be adjusted in a further step to the particular requirements of the final customer by the addition of the composition which is liquid at 25° C. and may comprise further additives. As a result of this, particularly economically viable preparation of small amounts of specific lubricating greases is possible.

After addition of the composition liquid at 25° C., a lubricating grease preferably has a water resistance of 1 to 50%, more preferably in the range from 5 to 35%. The cone penetration of preferred lubricating greases is in the range from 175 to 385 dmm, more preferably in the range from 220 dmm to 340 dmm.

The water resistance can be determined to ASTM D 4049. The cone penetration can be measured to ASTM D 1403.

In a particular embodiment of the present invention, the water resistance may be improved by at least 30%, more preferably by at least 50% and most preferably by at least 70%, based on the water resistance of the dispersion to which the composition liquid at 25° C. is added.

In a particular aspect of the present invention, the dispersion comprising grease structure and the composition liquid at 25° C. are essentially biodegradable. This is preferably measured to RAL-ZU 64.

The composition liquid at 25° C. can be added to the dispersion comprising grease structure by commonly known methods. These include stirring, mixing, kneading, rolling and/or homogenizing.

The temperature at which the composition liquid at 25° C. is added to the dispersion comprising grease structure is not critical per se. At a high temperature, the composition liquid at 25° C. can frequently be incorporated more easily into the dispersion. However, the grease structure must be stable at the addition temperature.

The composition liquid at 25° C. is preferably added to the dispersion comprising grease structure at a temperature which is below the dropping point of the dispersion before the addition of the liquid composition. The dropping point can be determined to ASTM D 2265.

More preferably, the composition liquid at 25° C. is added to the dispersion comprising grease structure at a temperature which is at least 40° C., most preferably at least 60° C., below the dropping point of the dispersion before the addition of the liquid composition.

In a preferred variant of the process according to the invention, the composition liquid at 25° C. can be added at a temperature in the range from 0° C. to 75° C., in particular in the range from 25° C. to 70° C.

The invention will be illustrated in detail below by examples and comparative examples, without any intention that the invention be restricted to these examples.

The following abbreviations are used below.

KV 100, KV 40=kinematic viscosity, measured to DIN 51562 at 100° C. and 40° C.

Typically, the polymer solutions described in the example are analysed in a 150 N test oil; the number in ( ) indicates the polymer concentration used.

[η] designates the limiting viscosity number, measured to DIN ISO 16281, part 6.

PREPARATION EXAMPLE 1

In a 2 liter four-neck flask equipped with stirrer, thermometer and reflux condenser, 70.3 g of an ethylene-propylene copolymer of thickening action 11.0 $mm^2/s$ in relation to KV 100 (for example thermally or mechanically degraded Dutral® CO 038) in a mixture consisting of 251.8 g of a 150 N oil and 47.9 g of a 100 N oil are weighed in, and dissolved at 100° C. within 10-12 hours. After the dissolution operation, 41.1 g of a mixture consisting of alkyl methacrylates with alkyl substitutents of chain lengths C10-C18 are added and the reaction mixture is inertized by adding dry ice. After the polymerization temperature of 130° C. has been attained, 0.52 g of 1,1-di(tert-butylperoxy)-3,3,5-tri-methylcyclohexane is added and, at the same time, a monomer feed consisting of 588.9 g of the analogous composition as above and 7.66 g of 1,1-di(tert-butyl-peroxy)-3,3,5-trimethylcyclohexane is started and added uniformly over a feed time of 3.5 hours. 2 hours after the end of feeding, the mixture is diluted to polymer content 47.55% with 472.1 g of an ethoxylated fatty alcohol (for example Marlipal® 013/20). At the same time, the temperature is reduced to 100° C., 1.26 g of tert-butyl peroctoate are added and the mixture is stirred at 100° C. for a further 2 hours. In a 1 liter Witt jar equipped with Inter-Mig stirrer (stirrer/vessel diameter ratio=0.7; stirrer speed set: 150 rpm), 286.2 g of the solution prepared, 43.2 g of an ethylene-propylene copolymer (for example Dutral® CO 038 degraded to 11.5 $mm^2/s$) and 170.6 g of a further ethylene-propylene copolymer (for example Dutral® ® CO 058 degraded to a KV 100 of 11.5 $mm^2/s$) are weighed in. Within 8-10 hours, a brownish dispersion forms at 100° C. and stirrer speed 150 rpm, and still tends to separate out the ethylene-propylene copolymers within a few weeks at room temperature. For stabilization, the temperature is therefore increased from 100° C. to 140° C. and the mixture is stirred further at 150 rpm for 6 hours. Subsequently, dilution with 136.6 g of an ethoxylated fatty alcohol (for example Marlipal® 013/20) dilutes the mixture to polymer content 55%, and the mixture is stirred further at 100° C. for half an hour. The KV 100 of the product thus produced is 3488 $mm^2/s$. The KV 100 of a 2.8% solution of the product in a 150 N oil is 11.43 $mm^2/s$. The resulting structure improvers are referred to as e-OCP.

PREPARATION EXAMPLE 2

Preparation of PAMA/Methacrylic Acid Polymers

In a 2 l four-neck flask equipped with stirrer, thermometer and reflux condenser, 6.1 g of methacrylic acid and 603.9 g of a C10-C18-alkyl methacrylate are dissolved in 499 g of 100 N oil, for example 100 SN from Kuwait Petroleum. The solution is inertized by means of addition of 10 g of dry ice and the temperature is subsequently increased to 82° C. On attainment of the temperature, the polymerization is initiated by adding 0.73 g of initiator (tert-butyl per-2-ethylhexyl hexanoate). 1.21 g of initiator are added after 4 hours of reaction time and 111 g of 100 N oil are added after a further 4 hours. The resultant polymer solution is approx. 50% strength.

KV 100 (2% strength in 150 N oil): 10.11 $mm^2/s$
KV 40 (2% strength in 150 N oil): 58.43 $mm^2/s$
[η] 136 $cm^3/g$

PREPARATION EXAMPLE 3

Preparation of a PAMA Polymer without Acid Function

Preparation Analogous to Example 2
Batch polymerization, 82° C., 55% in 100 N oil
495.0 g of 100 N oil
605.0 g of C12-C18 alkyl methacrylate
0.73 g of initiator (0.12%)
Replenishment step (after 4 h): 1.21 g of initiator (0.20%)
Dilution to 50% with 110.0 g of 100 N oil
KV 100 (2% strength in 150 N oil): 9.98 $mm^2/s$
KV 40 (2% strength in 150 N oil): 55.58 $mm^2/s$
[η]127 $cm^3/g$

PREPARATION EXAMPLE 4

Preparation of an NLGI Grade 2 Li Soap Grease (EG 2768)

A 6 l lubricating grease autoclave tank equipped with oil jacket heating and a mechanical planetary stirrer is charged with 272 g of hydrogenated castor oil (HCO, 181.6 mg KOH/g), 40 g of lithium hydroxide, 32 g of Vanlube NA (a diphenylamine from Vanderbilt), 32 g of Lubad 199 (a calcium salicylate from Shell), and 1440 g of HVI 650 oil from Shell and 1330 g of HVI 160 oil from Shell. The tank is closed and kept at 100° C./100 rpm for one hour. Subsequently, the water of reaction formed is discharged and the mixture is heated to 210° C. On attainment of the peak temperature, the mixture is cooled to 165° C. at a rate of 1° C./min at. 200 rpm. Subsequently, the mixture is cooled further to a temperature of 50° C. at 100 rpm. The tank is opened and the grease formed is homogenized at least twice by means of a three-roll mill, and transferred into a bucket.

Physical Data:

Cone penetration (IP 50) unprocessed: 285 dmm, 288 dmm after 60 motions (NLGI grade 2), 317 dmm after 100 060 motions.
propping point (ASTM D566): 197.7° C.
Water wash-out (ASTM D 1264): 7.5%
Water spray-off (ASTM D 4049): 33.8%

EXAMPLE 1

In a mixer (Kenwood Chef) 982 g of the lubricating grease RWZ obtainable from RCG Nordwest, of classification NLGI grade 2 based on lithium soaps, were mixed at 60° C. with 18 g of a e-OCP dispersion obtainable according to Preparation Example 1 and comprising 55% by weight of polymers and a lubricating oil. The resulting mixture was subsequently homogenized using a three-roll mill (Exact 50 from Exact Apparatebau). The properties of the modified lubricating grease were determined below.

For this purpose, more particularly, the dropping point was determined to ASTM D 566, cone penetration to ASTM D 217 and water resistance to ASTM D 4049. The data obtained are shown in Table 1.

COMPARATIVE EXAMPLE 1

Example 1 was essentially repeated, except that no e-OCP dispersion was incorporated. The data obtained are shown in Table 1.

COMPARATIVE EXAMPLE 2

Example 1 was essentially repeated, except that a lubricating oil was incorporated instead of the e-OCP dispersion. The resulting data are shown in Table 1.

EXAMPLE 2

Example 1 was essentially repeated, except that 100 g of a 5% OCP solution which is obtainable from Lubrizol under the trade name LZ 2002 D were incorporated instead of the e-OCP dispersion. The resulting data are shown in Table 1.

TABLE 1

| | Cone penetration after 60 motions | Dropping point | Water resistance | Improvement based on original grease |
|---|---|---|---|---|
| Ex. 1 | 285 | 181° C. | 17% | 71% |
| Comp. Ex. 1 | 263 | 183° C. | 59% | — |
| Comp. Ex. 2 | 290 | 180° C. | 61% | — |
| Ex. 2 | 279 | 182° C. | 13% | 78% |

EXAMPLE 3

In a mixer (Kenwood Chef), 991 g of the lubricating grease Farmlub obtainable from F&S Mannheim, of classification NLGI grade 2 and based on lithium soaps, were mixed at 60° C. with 9 g of an e-OCP dispersion obtainable according to Preparation Example 1 and comprising 55% by weight of polymers and a lubricating oil. The resulting mixture was subsequently homogenized by means of a three-roll mill (Exact 50 from Exact Apparatebau). The properties of the modified lubricating grease were determined below.

To this end, more particularly, the dropping point was determined to ASTM D 566, 1403, cone penetration to ASTM D 217 and water resistance to ASTM D 4049. The resulting data are shown in Table 2.

COMPARATIVE EXAMPLE 3

Example 3 was essentially repeated, except that no e-OCP dispersion was incorporated. The resulting data are shown in Table 2.

EXAMPLE 4

Example 3 was essentially repeated, except that 18 g of the e-OCP dispersion obtained according to the above Preparation Example 1 were incorporated. The resulting data are shown in Table 2.

EXAMPLE 5

In a mixer (Kenwood Chef), 990 g of the lubricating grease Farmlub obtainable from F&S Mannheim, of classification NLGI grade 2 and based on lithium soaps, were mixed at 60° C. with 10 g of a solution which comprises 50% by weight of polymers with acid groups which have been obtained according to Preparation Example 2 and a lubricating oil. The resulting mixture was subsequently homogenized by means of a three-roll mill (Exact 50 from Exact Apparatebau). The properties of the modified lubricating grease were determined below.

To this end, more particularly, the dropping point was determined to ASTM D 566, cone penetration to ASTM D 217 and water resistance to ASTM D 4049. The resulting data are shown in Table 2.

EXAMPLE 6

Example 5 was essentially repeated, except that 40 g of the solution which comprises 50% by weight of polymers having acid groups which have been obtained according to Preparation Example 2 and a lubricating oil were incorporated into 960 g of lubricating grease from F&S Mannheim. The resulting data are shown in Table 2.

EXAMPLE 7

Example 6 was essentially repeated, except that 20 g of a dispersion which comprises 50% by weight of polymers having no acid groups which have been obtained according to Preparation Example 3 and a lubricating oil were incorporated into 980 g of grease from F&S Mannheim. The resulting data are shown in Table 2.

EXAMPLE 8

Example 5 was essentially repeated, except that 10 g of a dispersion which comprises 50% by weight of polymers having no acid groups which have been obtained according to Preparation. Example 3 and a lubricating oil were incorporated. The data obtained are shown in Table 2.

TABLE 2

| | Cone penetration after 60 motions | Dropping point | Water resistance | Improvement based on original grease |
|---|---|---|---|---|
| Ex. 3 | 255 | 187° C. | 21% | 66% |
| Comp. Ex. 3 | 251 | 186° C. | 62% | — |
| Ex. 4 | 268 | 188° C. | 23% | 63% |
| Ex. 5 | 291 | 182° C. | 20% | 68% |
| Ex. 6 | 294 | 185° C. | 11% | 82% |
| Ex. 7 | — | 183° C. | 28% | 55% |
| Ex. 8 | — | 188° C. | 40% | 35% |

EXAMPLE 9

In a mixer (Kenwood Chef), 990 g of the lubricating grease EG 2768 of classification NLGI grade 2 based on lithium soaps, obtainable according to Preparation Example 3, were mixed at 60° C. with 10 g of a solution which comprises 50% by weight of polymers having acid groups which have been obtained according to Preparation Example 2 and a lubricating oil. The resulting mixture was subsequently homogenized by means of a three-roll mill (Exact 50 from Exact Apparatebau). The properties of the modified lubricating grease were determined below.

For this purpose, more particularly, the dropping point was measured to ASTM D 566, cone penetration to ASTM D 217 and water resistance to ASTM D 4049. The data obtained are presented in Table 3.

COMPARATIVE EXAMPLE 4

Example 9 was essentially repeated, except that no solution was incorporated. The data obtained are presented in Table 3.

EXAMPLE 10

Example 9 was essentially repeated, except that a solution was incorporated which comprises 50% by weight of polymers without acid groups which have been obtained according to Preparation Example 3 and a lubricating oil. The resulting data are shown in Table 3.

TABLE 3

| | Cone penetration after 60 motions | Dropping point | Water resistance | Improvement based on original grease |
|---|---|---|---|---|
| Ex. 9 | 291 | 197° C. | 20% | 41% |
| Comp. Ex. 4 | 288 | 198° C. | 34% | — |
| Ex. 10 | 279 | 198° C. | 27% | 21% |

The invention claimed is:

1. A process for producing a lubricating grease, comprising:

adding a polymeric structure improver to a dispersion which has a grease structure, wherein the dispersion comprises at least one thickener and at least one lubricating oil, and wherein the polymeric structure improver is added in the form of a composition which is a liquid at 25° C., and wherein the polymeric structure improver is obtained by polymerizing a monomer composition comprising:

a) 0 to 40% by weight, based on the weight of the monomer compositions for preparing the polymeric structure improvers, of one or more ethylenically unsaturated ester compounds of the formula (I)

(I)

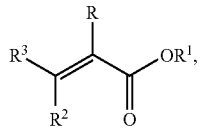

wherein R is hydrogen or methyl, $R^1$ is a linear or branched alkyl radical having 1 to 5 carbon atoms, $R^2$ and $R^3$ are each independently hydrogen or a group of the formula —COOR' where R' is hydrogen or an alkyl group having 1 to 5 carbon atoms, b) 50 to 100% by weight, based on the weight of the monomer compositions for preparing the polymeric structure improver, of one or more ethylenically unsaturated ester compounds of formula (II)

(II)

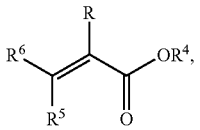

wherein R is hydrogen or methyl, $R^4$ is a linear or branched alkyl radical having from 6 to 30 carbon atoms, $R^5$ and $R^6$ are each independently hydrogen or a group of the formula —COOR", where R" is hydrogen or an alkyl group having 6 to 30 carbon atoms, and c) 0.01 to 20% by weight, based on the weight of the monomer compositions for preparing the polymeric structure improvers, of acid-bearing monomers or salts thereof comprising at least one monomer selected from the group consisting of methacrylic acid and acrylic acid or salts thereof.

2. The process according to claim 1, wherein said composition has a viscosity within the range of from 1 $mm^2/s$ to 10,000 $mm^2/s$.

3. The process according to claim 1, wherein said composition comprises a lubricating oil.

4. The process according to claim 3, wherein said lubricating oil is compatible with the lubricating oil of the lubricating grease.

5. The process according to claim 1, wherein said polymeric structure improver has a weight-average molecular weight within the range of from 15,000 g/mol to 1,000,000 g/mol.

6. The process according to claim 1, wherein the concentration of said polymeric structure improver in the lubricating grease is within the range of from 0.1 to 20% by weight.

7. The process according to claim 1, wherein the ratio of the weight of said dispersion to the weight of said composition is within the range of from 100:1 to 1:1.

8. The process according to claim 1, wherein said acid-bearing monomers or salts thereof which are present in component c) comprise at least one phosphonic acid group and/or at least one sulphonic acid group.

9. The process according to claim 1, wherein component c) comprises 0.1 to 10% by weight, based on the weight of the monomer compositions for preparing the polymeric structure improvers, of acid-bearing monomers or salts thereof.

10. The process according to claim 1, wherein said composition comprises additives.

11. The process according to claim 1, wherein said composition is a solution.

12. The process according to claim 1, wherein said composition is a dispersion.

13. The process according to claim 1, wherein said composition is added at a temperature which is below the dropping point of the lubricating grease before the addition of said composition.

14. The process according to claim 1, wherein said composition is added at a temperature which is at least 60° C. below the dropping point of the lubricating grease before the addition of said composition.

15. The process according to claim 1, wherein said composition is added at a temperature within the range of from 20° C. to 75° C.

16. The process according to claim 1, wherein said thickener is selected from the group consisting of a soap thickener, an inorganic thickener and a polymeric organic thickener.

17. The process according to claim 1, wherein the lubricating grease, after the addition of said composition, has a water resistance of 1 to 50%.

18. The process according to claim 1, wherein the lubricating grease, after the addition of said composition, has a cone penetration within the range of from 175 dmm to 385 dmm.

19. The process according to claim 1, wherein said composition is added to the dispersion having a grease structure by stirring, mixing, kneading, rolling or homogenizing.

* * * * *

UNITED STATES PATENT AND TRADEMARK OFFICE

CERTIFICATE OF CORRECTION

PATENT NO. : 8,785,358 B2
APPLICATION NO. : 11/587988
DATED : July 22, 2014
INVENTOR(S) : Matthias Fischer et al.

It is certified that error appears in the above-identified patent and that said Letters Patent is hereby corrected as shown below:

Title page, Item (87), the PCT Pub. No. should read:

--(87) PCT Pub. No.: WO2006/094520
PCT Pub. Date: Sep. 14, 2006--

Signed and Sealed this
Third Day of February, 2015

Michelle K. Lee

Michelle K. Lee
*Deputy Director of the United States Patent and Trademark Office*